US008185975B2

(12) United States Patent
McDaniel

(10) Patent No.: US 8,185,975 B2
(45) Date of Patent: May 29, 2012

(54) SELF-RINSING TOILET RIM COVER AND METHOD FOR USING IT

(76) Inventor: Gregory McDaniel, Surfside, FL (US)

( * ) Notice: Subject to any disclaimer, the term of this patent is extended or adjusted under 35 U.S.C. 154(b) by 365 days.

(21) Appl. No.: 12/386,017

(22) Filed: Apr. 13, 2009

(65) Prior Publication Data

US 2009/0260141 A1 Oct. 22, 2009

Related U.S. Application Data

(60) Provisional application No. 61/124,395, filed on Apr. 17, 2008.

(51) Int. Cl.
*E03D 9/10* (2006.01)

(52) U.S. Cl. ..... 4/300.3; 4/429; 4/DIG. 5

(58) Field of Classification Search ..... 4/246.1–246.5, 4/300, 300.3, 421, 429, 901, DIG. 5
See application file for complete search history.

(56) References Cited

U.S. PATENT DOCUMENTS 1,492,825 A * 5/1924 Abbott ..... 4/233
4,063,316 A * 12/1977 Hunninghaus ..... 4/233
4,234,975 A * 11/1980 Revels ..... 4/300
4,551,866 A * 11/1985 Hibbs ..... 4/246.1
5,193,230 A * 3/1993 Guerty ..... 4/246.2
5,222,260 A * 6/1993 Piper ..... 4/246.1
5,259,072 A * 11/1993 Trombley ..... 4/213
5,279,000 A * 1/1994 Mercier et al. ..... 4/240
5,283,913 A * 2/1994 Jaeckels ..... 4/420
5,289,593 A * 3/1994 Lawrence ..... 4/246.1
5,291,618 A * 3/1994 Chiang ..... 4/241
5,504,947 A * 4/1996 Robellop et al. ..... 4/246.1
5,596,774 A * 1/1997 Howard ..... 4/420
5,754,985 A * 5/1998 Dias ..... 4/246.1
6,438,764 B1 * 8/2002 Andersen ..... 4/246.1
6,519,786 B1 * 2/2003 Francis ..... 4/300.3
6,526,600 B1 * 3/2003 Hernandez ..... 4/246.1
7,263,727 B1 * 9/2007 Zhurin et al. ..... 4/300
7,263,758 B2 * 9/2007 Davies et al. ..... 29/527.3
2004/0231036 A1 * 11/2004 Andersen ..... 4/246.1

* cited by examiner

*Primary Examiner* — Brian Glessner
*Assistant Examiner* — Babajide Demuren

(57) ABSTRACT

One embodiment of a self cleaning toilet bowl rim cover having a water conveyance (5) one end of which is hydraulically connected to water intake valve (9) the other end of water conveyance (5) opens over higher end of inclined surface (1) which slopes downward to drain (4) which is positioned over toilet bowl interior (7) Other embodiments are described and shown.

1 Claim, 6 Drawing Sheets

Fig 1 Overview

Parts of typical toilet tank

Fig 3 typical toilet tank parts
with invention attached

Additional Embodiment
Alternate water source

Fig. 5 Modified Toilet Rim Crosssection
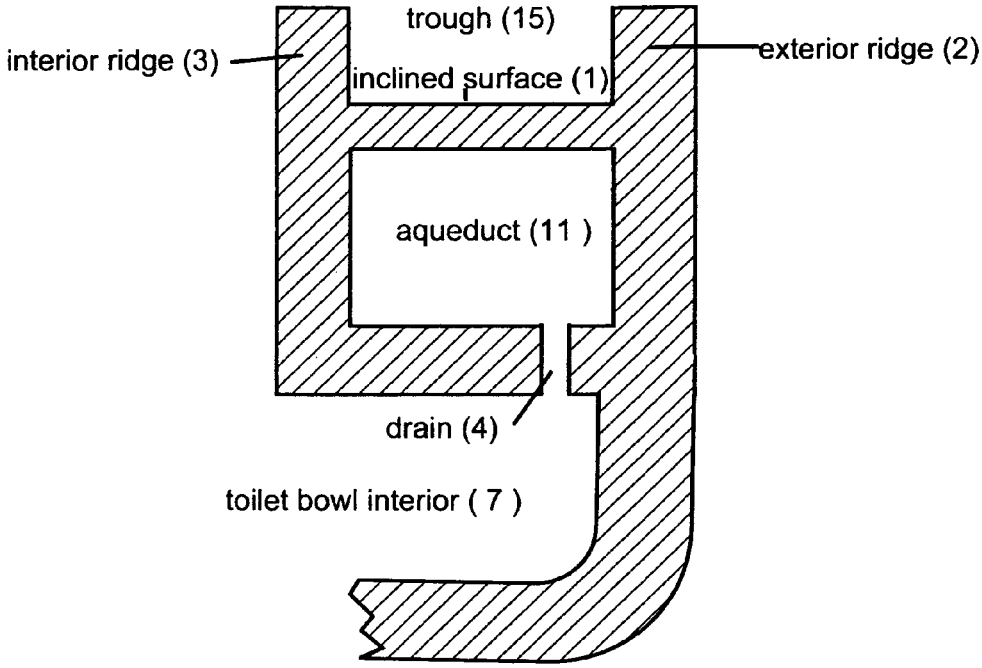
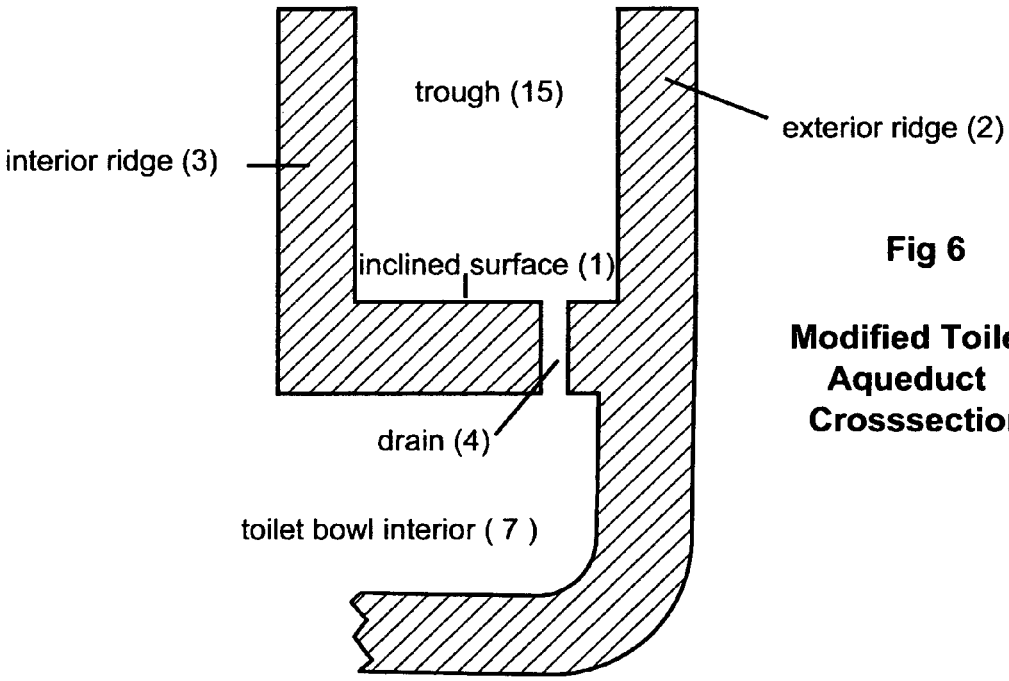
Fig 6
Modified Toilet Aqueduct Crosssection

Side View of Second Embodiment
Toilet Rim Cover with Toilet Seat,
Toilet Lid, and Apparatus
to Attach to Toilet Bowl Rim cover modified to serve as toilet seat
Overview

SELF-RINSING TOILET RIM COVER AND METHOD FOR USING IT

CROSS REFERENCE TO RELATED APPLICATIONS

The present application claims priority from U.S. provisional patent application No. 61/124,395 filed on Apr. 17, 2008 and hereby incorporated by reference.

BACKGROUND

1. Field

The present application relates to toilets, and specifically to a device and method to automatically maintain the bowl rim, seat attachment area, and the bowl exterior clean and free of urine without the need of additional work.

2. Prior Art

It is well known that toilet bowl rims and toilet bowl exteriors often become dirty due to male urination outside the cavity of the toilet bowl, I.e. on the rim. As a consequence some of the urine may flow down the exterior side of the bowl leaving residues that, over time, become dray stains. Urine may also flow back from the rim to the seat attachment area where it may stay and dry. The consequences of this urine include microbial growth, urine smell, unsightly incrustation of the toilet rim, seat attachment area, and toilet bowl exterior.

This situation may become a problem both in public restrooms and in private bathrooms because, for example, it makes the toilet unsightly, and unsanitary. Additionally, the resulting mess is a frequent cause of irritation to women and of stress and tension between couples.

Currently frequent cleaning is required to keep the toilet presentable and sanitary. Brushes, rags, and paper towels have been used together with cleaning fluids, solutions, soaps, and disinfectants to keep and maintain the toilet rim, seat attachment area, and bowl exterior clean and sanitary. These cleaning operations are often unpleasant, use costly cleaners, and are time consuming ultimately resulting in a loss of time and money. An additional problem is that the toilet is unattractive and unsanitary between cleanings.

DESCRIPTION OF THE RELATED ART

Different prior art patents unsuccessfully attempted to address the issue of a self cleaning toilet rim. For example, U.S. Pat. No. 6,944,894 to Blevins discloses and claims a toilet bowl automatically flushes and lowers with a cylinder to a cleaning position. The interior of the bowl is then contacted by a brush cleaning assembly, including a detergent spray and water rinse and then is raised back up to the ready-for-use position. The Blevins patent does not address the issue of catching and holding urine that falls on the toilet bowl rim.

Earlier U.S. Pat. No. 4,790,039 to Speer discloses and claims a portable toilet that is equipped with a toilet seat having a cover thereon which is capable of delivering a charge of sanitizing and/or deodorizing fluid onto the upper surface thereof. Under the teaching of the Speer patent the source of sanitizing and/or deodorizing fluid is periodically energized. The Speer patent requires the installation of a costly gas or fluid source that jeopardizes its commercial success. The Speer patent does not address the issue of catching and holding urine that falls on the toilet bowl rim.

U.S. Pat. Nos. 4,875,243 and 4,745,639 to Wilemann III disclose and claim similar inventions directed to a toilet apparatus comprising a bowl, a holding tank, a seat member adapted to overlie a rim portion of said bowl, a cover member adapted to overlie the seat member, at least one of the seat and cover members having a channel therein and holes extending from the channel to an undersurface thereof to facilitate passage of fluid through the channel and holes, and a slide assembly first switch operable in conjunction with a float assembly second switch to correlate the completion of a flushing and holding tank refilling cycle with the completion of a cycle of fluid passage through the channel and holes. Both the Wilemann patents are relevant because they address one possible solution to the problem solved by the present invention. However the Wilemann patents do not address the issue of catching and holding urine that falls on the toilet bowl rim.

U.S. Pat. No. 5,813,057 to Descent discloses and claims a self-sanitizing toilet seat cleaning apparatus includes a seat in the shape of a generally circular ring that is rotatable mounted above the toilet bowl and includes a gear on its underside meshing with a pinion gear attached to the drive shaft of a drive motor for the seat. According to the teaching of the Descent patent an arm extends over a rear portion of the seat and includes flow passages that convey a disinfectant on top of the seat, under the seat, and into the toilet bowl. Under said arm, a wiper is provided in the descend patent includes a weight sensor that stops rotation f the seat if a person is sitting on it and a proximity sensor to activate flushing of the toilet and rotation and disinfection of the seat and bowl. However the Descent patent does not address the issue of catching and holding urine that falls on the toilet bowl rim. The Descent patent requires complex an costly apparatus.

U.S. Pat. No. 7,028,346 granted on Apr. 18, 2006 to Ermini points out all the defects of the prior art and brings back up the question of how a toilet can be cleaned cheaply, efficiently, automatically, and without the use of chemicals. Ermini try's to overcome the shortfalls of the prior art by providing for a toilet seat having a generally ring-like shape, with an upper surface, that comes into contact with the user's skin, defined between an external perimeter edge and an internal perimeter edge, the seat comprising, or being associated with, a plurality of spray nozzles for spraying sanitizing fluid over the upper surface. Under the teaching of the Ermini patent said seat has a passage arranged in such a manner as to have a fluid inlet opening along the external perimeter edge and outlet opening along the internal perimeter edge, the inlet opening being shaped so as to collect any excess fluid flowing beyond the external edge, such that the excess fluid drains through the passage, out the outlet opening and into the toilet bowl. However the Ermini patent does not address the issue of catching and holding urine that falls on the toilet bowl rim.

The Ermini patent reviews quite comprehensively the shortfall of the prior art but the solution provided therein is technologically advanced and extremely expensive. Thus there is the need in the art for a simple apparatus that can provide a cheap, convenient, cost effective solution to prevent the toilet bowl exterior, rim, and seat attachment area from becoming soiled and for the automatic cleaning of the toilet bowl rim and seat attachment area without the use of chemicals, intensive labor, rags, and additional mechanical devices.

OBJECTS AND ADVANTAGES

Accordingly it is one of the advantages of the present application to provide a trough for a toilet bowl in which urine can be confined.

It is one of the advantages of the present application to provide a means for automatically keeping the toilet bowl rim, toilet bowl seat attachment area, and toilet bowl exterior clean. It is an additional advantage of the present application to provide a means for cleaning toilet bowl rim and seat attachment area without complex, bulky, and time consuming operations, and with a minimal amount of chemicals and cleaning apparatus and a minimum of manual labor.

It is one of the advantages of the present application to provide a means of keeping the toilet bowl rim and seat attachment area clean with every flush. Additionally, it is one of the advantages of the present application to provide a method and apparatus to reduce human work and effort to clean toilets. Further, it is an advantage of the present application to reduce tension between men and women by eliminating the urine mess that women often leave on toilets which women often clean.

Further objects and advantages will become apparent from the consideration of the drawings and ensuing description.

SUMMARY

In accordance with one embodiment a toilet bowl rim tough-like cover having a drain and a water conveyance which is sized so it can be hydraulically connected to an intake valve.

BRIEF DESCRIPTION OF THE DRAWINGS

FIG. 3 shows a typical toilet tank and toilet parts of the prior art assembled together with one of the parts of the present application

FIG. 5. Shows a cross-section of a modified toilet rim

FIG. 6 shows a cross-section of a modified toilet aqueduct

Figure 1:
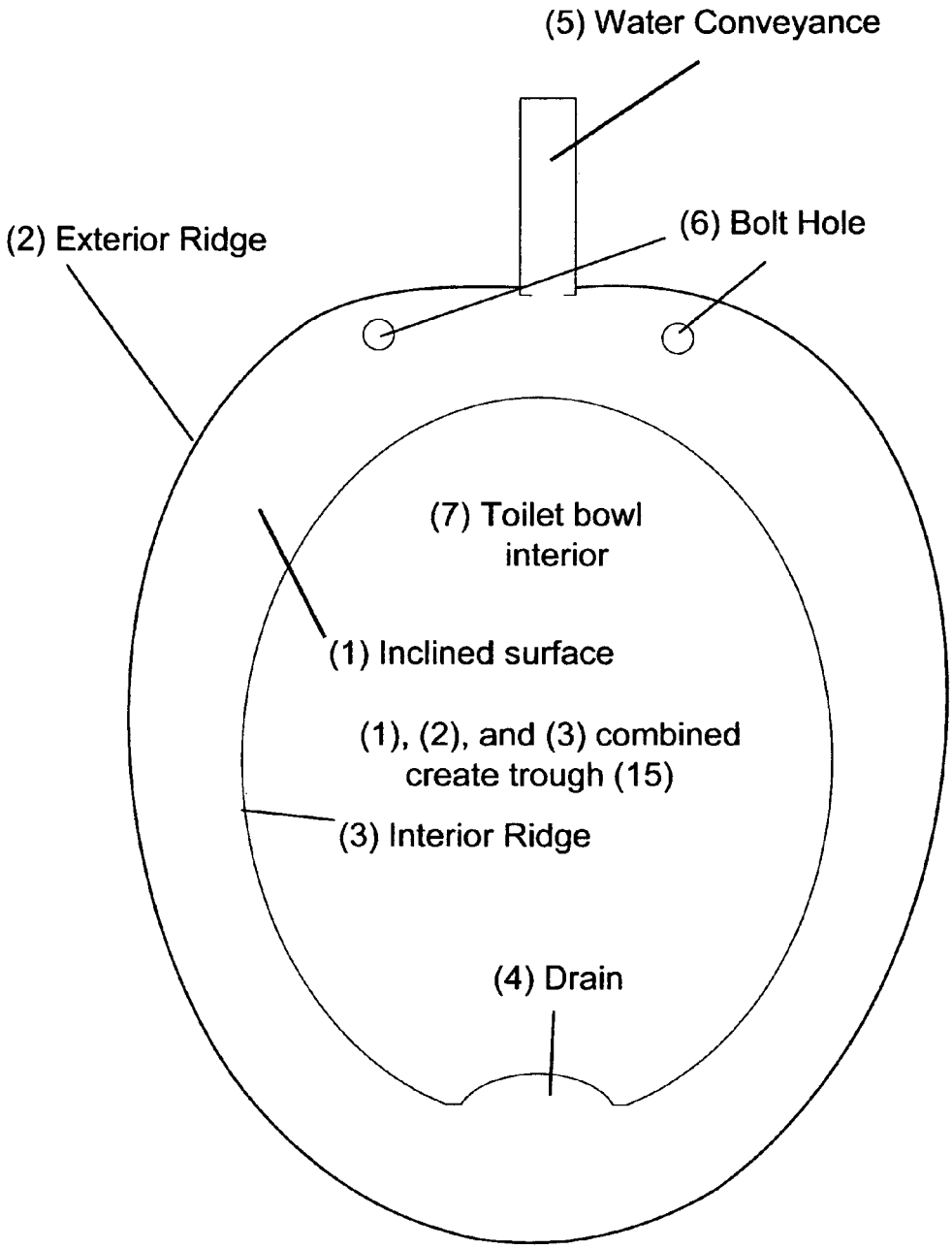
FIG. 1 shows an overview of one of the embodiments of the present application
Figure 2:
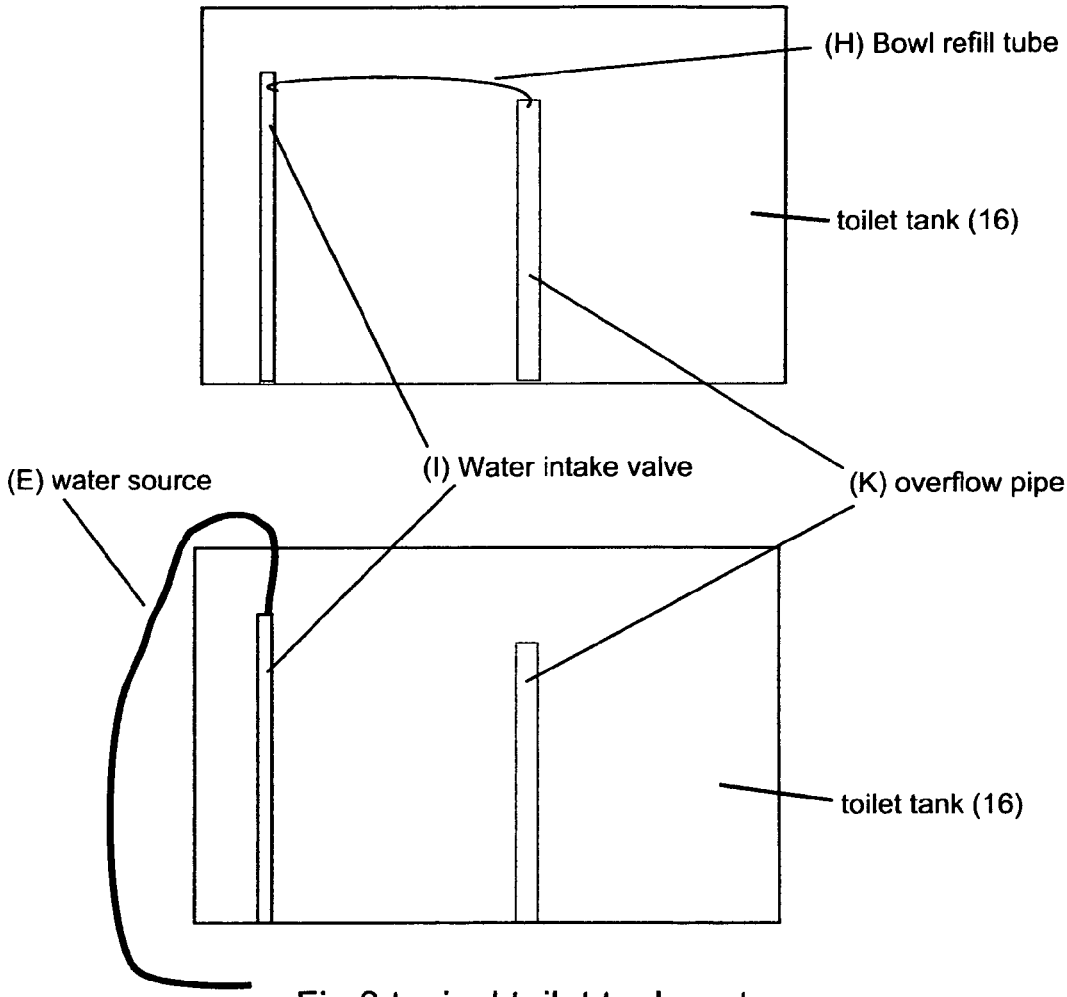
FIG. 2 shows the typical toilet tank and the toilet parts of the prior art
Figure 4:
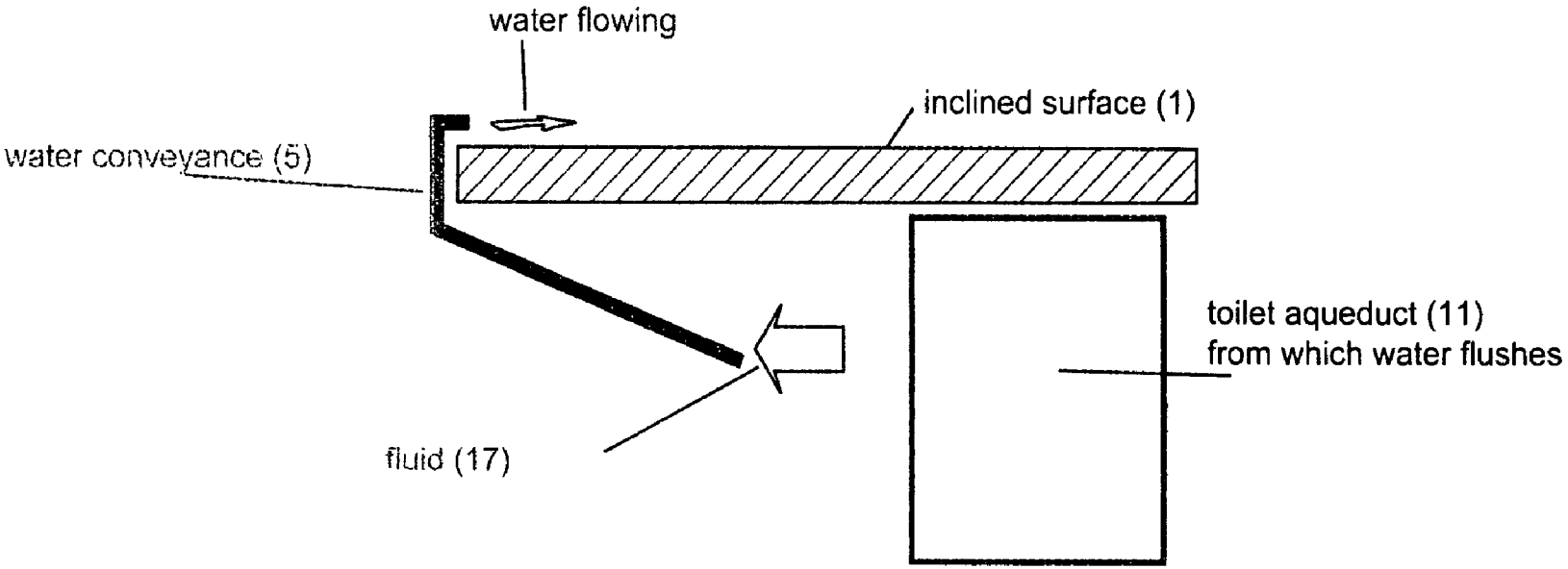
FIG. 4 shows a cross-section of an embodiment of the present application that uses an alternative water source.
Figure 7:
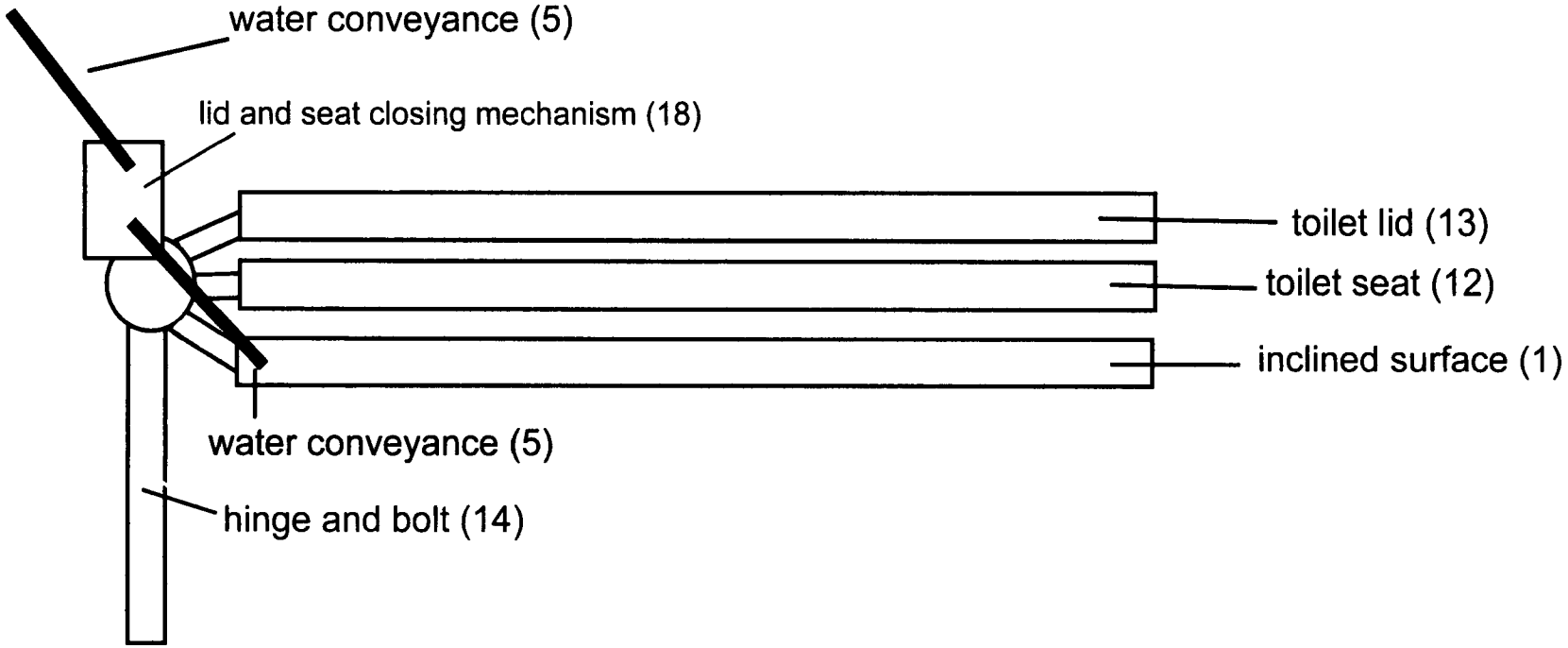
FIG. 7 shows a toilet rim cover combined with a toilet seat and lid
Figure 8:
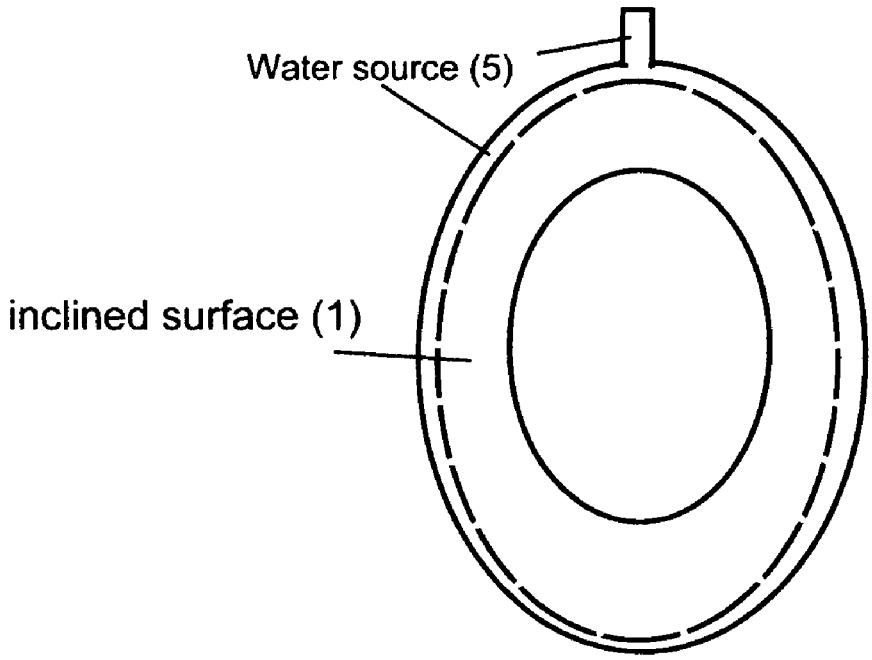
FIG. 8 shows a rim cover modified to serve as toilet seat.

LIST OF REFERENCE NUMBERS (1) an inclined surface
(2) exterior ridge
(3) interior ridge
(4) drain
(5) water conveyance
(6) bolt holes
(7) toilet bowl interior
(8) bowl refill tube
(9) water intake valve
(10) overflow pipe
(11) toilet aqueduct
(12) toilet seat
(13) toilet lid
(14) hinge and bolts
(15) trough
(16) toilet tank
(17) fluid
(18) lid and seat closing mechanism

DETAILED DESCRIPTION

First Embodiment

FIG. 1

Now with reference to the drawings that are an integral part of this disclosure and are provided for reference only, not to be interpreted in a limiting sense, one of the embodiments of the present invention is illustrated in detail.

With reference to FIG. 1 it is shown that one of the embodiments of the present application comprises inclined surface (1), shaped substantially like a toilet bowl rim's upper surface. Inclined surface (1) has two ridges, exterior ridge (2) and interior ridge (3). Interior ridge (3) extends to each side of drain (4). Inclined surface (1), exterior ridge (2), interior ridge (3), and drain (4) form trough (15) One end of water conveyance (5) is positioned over the higher part of trough (15). The other end of water conveyance (5) is hydraulically connected to water intake valve (9). Water conveyance (5) replaces bowl refill tube (8) which pours into overflow pipe (10) in standard toilets.

FIG. 1 also shows that bolt holes (6) are provided to inclined surface (1) through which trough (15) can be anchored to toilet bowl. Still in FIG. 1 it is shown that trough (15) slopes from a higher level where water conveyance (5) opens to a lower interior level where drain (4) is located.

Operation

At the time a male user urinates both toilet lid and toilet seat are in the up position. During urination the male user accidentally drop urine in trough (15). When toilet is flushed water intake valve (9) is activated and releases pressurized water into one end of water conveyance (5).

Pressurized water is propelled through water conveyance (5) and out of the other end of water conveyance (5). Upon exiting water conveyance (5) water is no longer pressurized. Water is then propelled by gravity onto the higher end of trough (15). Water then flows downward to the lower interior end of trough (15) where drain (4) is located. Then the water flows over or through drain (4) and into toilet bowl interior (7). While flowing downward through trough (15) the water will dilute and carry any urine previously dropped by user so urine and water will pour downward in combination ultimately into toilet bowl interior (7)). In this way trough (15) is kept rinsed and clean every time the toilet is flushed without the need of complex and unpleasant cleaning operations, the use of dangerous chemicals, or of bulky mechanical devices.

Description

In a second embodiment of the present application the claimed self cleaning device is designed to be manufactured as an integral part of a standard toilet seat and toilet lid combination which will in this embodiment comprise three main parts rather than two: lid, seat, and self cleaning toilet rim cover claimed and disclosed. All three parts are associated with a system to anchor all three components to the toilet rim. There are no bolt holes in this embodiment.

Operation

The operation of this embodiment is the same as in the first embodiment.

Description

A fourth embodiment of the present application comprises a modification of toilet aqueduct (11) (that typically conveys water used to flush a typical toilet from the toilet tank to the toilet bowl. Toilet aqueduct (11) is typically covered on the top side by a toilet rim. According to the teaching of this fourth embodiment the top side of toilet aqueduct (11) is not fully covered by a toilet bowl rim, but is open to some degree so that urine that would have fallen on a toilet rim, if a rim were there, instead falls into toilet aqueduct (11).

Toilet aqueduct (11) functions as trough (15) as described in other embodiments. The functions of inclined surface (1) are performed by the floor of toilet aqueduct (11). The functions of exterior ridge (2) are performed by the exterior wall of toilet aqueduct (11). The functions of interior ridge (3) are performed by the interior wall of toilet aqueduct (11). The functions of drain (4) are performed by the holes in the floor of toilet aqueduct (11). The functions of water conveyance (5) are performed by the typical pathway for water to flow from toilet tank (16) to toilet aqueduct (15) under toilet bowl rim in a typical toilet. The functions of drain (4) are performed by a plurality of drain (4) holes in the floor of toilet aqueduct (11).

All the elements of this embodiment are standard of typical toilets available today except that toilet bowl is to some degree open to allow urine to fall into aqueduct (11) instead of on toilet bowl rim Operation The operation of this embodiment is the same as in the first embodiment.

Description

In the fifth embodiment of the present application all elements are the same as in either the first, second, or third embodiments with the exception that the source of water is changed. In the fifth embodiment water conveyance (5) is not attached to water intake valve (9). Water conveyance (5) has two ends, a first end and a second end. The second end is positioned to deliver water into trough (15). The first end is designed and positioned to collect water. The second end is positioned in the path of the flow of water as it is flushing into toilet bowl interior (7). The pressure of flushing water rushing into bowl interior (7) will force some water into and through water conveyance (5). As described in previous embodiments water will then pour out of second end of water of water conveyance (5) and pour onto higher end of trough (15). The water will then flow down trough (15) diluting and carrying any urine in trough (15). Water and urine will then flow over drain (4) into bowl interior (7). Thus trough (15) will be rinsed and cleaned of any urine deposited on it every time toilet is flushed.

Operation

The operation of this embodiment is the same as in the first embodiment.

Description

In a sixth embodiment the elements of the first embodiment are used, but inclined surface (1) is shaped to function as a toilet seat, not a toilet rim cover. Depending on design, interior ridge (3) may be omitted.

Operation

At the time male user urinates toilet lid is in the up position. During urination male user accidentally drops urine on inclined surface (1) which is shaped like and functions as toilet seat (12). When toilet is flushed water intake valve (9) is activated and releases pressurized water into one end of water conveyance (5). The water flows over inclined surface (1), over drain (4), and into bowl interior (7) thus rinsing inclined surface (1) clean.

Description

In a seventh embodiment water conveyance (5) does not pour directly into trough (15) but first triggers a mechanism which causes the toilet seat (12) and toilet lid (13 to lower to the down position.

Operation

The operation of this embodiment is the same as in the first embodiment

CONCLUSION

The present application described in the disclosure, drawings, and claims attached therein is a device that conveniently helps to confine urine to a limited area and thereby eliminate urine and dry urine encrustation in hard to clean areas of toilets. The rim cover of the present application lays on top of toilet bowl rim and prevents urine from falling on the rim, but instead holds urine on inclined surface (1). Inclined surface (1) has two edges. Exterior ridge (2) prevents urine from flowing over the exterior edge of toilet bowl rim onto the bowl exterior.

The application not only has the functions to collect and confine urine on inclined surface (1), but also to allow for a means to rinse urine into toilet bowl interior (7) each time toilet is flushed. Water intake valve (9) is hydraulically attached to refill tube (8) in typical toilets today. In one of the embodiments of the present application said refill tube (8) is replaced by water conveyance (5) that conveys water from water intake valve (9) to the higher level of inclined surface (1).

After being delivered on the higher level of inclined surface (1), water is forced by gravity to flow from higher level to lowest level and further onto or through drain (4). From drain (4) water flows down into bowl interior (7). Thus with every flush of toilet pressurized water is forced from water intake valve (9) through water conveyance (5) onto the higher level of inclined surface (1) on which said water flows down to the lowest level of inclined surface (1). Water dilutes and carries urine that it encounters on inclined surface (1). Water and urine then pass over or through drain (4) and pour into bowl interior (7).

Said operations result in a toilet being kept clean and sanitary without the use of chemical, manual labor, cleaning materials, or complex mechanical devices. While six embodiments of the toilet rim or toilet rim cover device of the present application have been described in detail, it should be apparent that modifications and variations thereto are possible, all of which fall into the true spirit and scope of the application. With respect to the above description the, it is to be realized that the optimum dimensional relationships for the parts of the application, to include variations in size, material, shape, form, function and manner of operation, assembly and use, are deemed readily apparent and obvious to one skilled in the art, and all equivalent relationships to those illustrated in the drawings and described in the specification are intended to be encompassed by the present application.

For example, any suitable sturdy material such as plastic, aluminum, stainless steel, painted metal, ceramic, or composite material may be used. Also, trough (15) may be made of rubber or plastic, or ceramic, or metallic material. Although flushing with water only has been described, it should be appreciated that any suitable flushing fluids could be used including a sanitizing solution w8thout departing from the teaching of the disclosure. Furthermore, a wide variety of toilet bowls with varying color, shape, and design may6 be used in association with the present application.

The invention claimed is:

1. A self-rinsing toilet rim cover configured for placement on a toilet bowl rim comprising:

a trough with a shape substantially equivalent to the upper surface of a toilet bowl rim having an inclined base having a higher end and a lower end wherein the base includes apertures or spouts for draining fluid positioned in the lower end of the base into the interior of a toilet bowl when installed; and a water conveyance for supplying fluid into said trough having a first and a second end; wherein the first end is designed and positioned to collect water when flushing such that pressurized water is propelled through said first end and out of the second end on to the higher end of the trough, said collected water is then propelled by gravity from the higher end flowing downward to the lower interior end of trough over and through said apertures or spouts and into toilet the bowl interior such that the water flowing downward will dilute and carry any urine previously dropped in the trough through the said apertures or spouts into the bowl interior, rinsing and cleaning any urine deposited on the rim every time toilet is flushed without the need of complex and unpleasant cleaning operations, the use of dangerous chemicals, or the use of bulky mechanical devices and;

a means for attaching the self-rinsing rim cover to said toilet bowl comprising a bolt.

* * * * *